US008465223B2

(12) United States Patent
Bjorklund

(10) Patent No.: US 8,465,223 B2
(45) Date of Patent: Jun. 18, 2013

(54) PAVEMENT MARKER, METHOD AND APPARATUS

(75) Inventor: Mark S. Bjorklund, Midland, GA (US)

(73) Assignee: Fortson-Peek Company, Inc., Columbus, GA (US)

( * ) Notice: Subject to any disclaimer, the term of this patent is extended or adjusted under 35 U.S.C. 154(b) by 0 days.

(21) Appl. No.: 13/365,614

(22) Filed: Feb. 3, 2012

(65) Prior Publication Data

US 2012/0134747 A1 May 31, 2012

Related U.S. Application Data

(60) Division of application No. 12/749,877, filed on Mar. 30, 2010, now Pat. No. 8,123,430, and a continuation-in-part of application No. 12/362,729, filed on Jan. 30, 2009.

(51) Int. Cl.
*E01C 23/16* (2006.01)

(52) U.S. Cl.
USPC ..... 404/94

(58) Field of Classification Search
USPC ..... 404/10, 11, 15, 16, 93, 94, 72
See application file for complete search history.

(56) References Cited

U.S. PATENT DOCUMENTS

| | | | | |
|---|---|---|---|---|
| 3,418,896 A | | 12/1968 | Rideout | |
| 4,136,991 A | | 1/1979 | Clark et al. | |
| 4,279,534 A | | 7/1981 | Eigenmann | |
| 4,369,001 A | | 1/1983 | Eigenmann | |
| 4,373,670 A | * | 2/1983 | Kilner | 239/172 |
| 4,607,978 A | | 8/1986 | Eigenmann | |
| 4,652,172 A | | 3/1987 | Eigenmann | |
| 4,681,480 A | | 7/1987 | Eigenmann | |
| 4,936,485 A | | 6/1990 | Downing | |
| 4,983,458 A | | 1/1991 | Dejaiffe | |
| 5,039,557 A | | 8/1991 | White | |
| 5,897,914 A | | 4/1999 | DePriest | |
| 5,941,655 A | | 8/1999 | Jacobs et al. | |
| 6,059,488 A | * | 5/2000 | Green | 404/12 |
| 6,079,899 A | * | 6/2000 | Green | 404/12 |
| 6,326,053 B1 | | 12/2001 | Stump et al. | |

FOREIGN PATENT DOCUMENTS

GB 2271797 4/1994

* cited by examiner

*Primary Examiner* — Thomas B Will
*Assistant Examiner* — Abigail A Risic
(74) *Attorney, Agent, or Firm* — Thomas/Horstemeyer, LLP

(57) ABSTRACT

Disclosed are pavement markers and a mobile highway marking apparatus for advancing in a forward direction along a paved surface of a highway for applying a paint stripe to the paved surface and applying pavement markers at intervals on the paint stripe. The marking apparatus includes a dispenser that is configured for moving a sequence of the pavement markers form the bottom of an upwardly extending stack of the pavement markers first in the forward direction and then down a sloped chute in a rearward direction to the paint stripe without turning the pavement markers over.

16 Claims, 9 Drawing Sheets

PAVEMENT MARKER, METHOD AND APPARATUS

CROSS REFERENCE

This is a division of U.S. patent application Ser. No. 12/749,877, filed Mar. 30, 2010, and is a continuation-in-part of U.S. patent application Ser. No. 12/362,729 filed Jan. 30, 2009.

TECHNICAL FIELD

This disclosure concerns a retro-reflective pavement marker that is fixed to a base line of roadway marking or "striping" such that an audible and vibratory effect is produced in a vehicle when a wheel of the vehicle drives over the marker, the pavement marker reflects lights from a vehicle to the driver of the vehicle, and concerns the method and apparatus for applying the marker to a highway.

BACKGROUND

It is common in automobile traffic control to use pavement markings for directing vehicles. Typically, solid lines and skip lines are formed on the surface of pavement to guide the drivers of vehicles in safe traffic flow arrangements.

In order to reduce accidents involving vehicles running off of the road or out of a lane, pavement markings are used that produce an audible and vibratory effect when a wheel of a vehicle drives over the markings. One such pavement marking involves including a small bump at intervals on a base line of the highway. The bumps may be applied by extruding a molten or uncured lump of a specially designed material onto the base line of pavement striping. Upon curing, the lump of material becomes a solid bump and produces the audible vibratory effect when driven over. This bump line approach has been mostly avoided by contractors due to slow application speeds, high material consumption, and excessive cure times as much as fifteen minutes or more. Other problems exist with variations in size and shape of the bump that may be produced, for example, by temperature and viscosity fluctuations.

It is known that objects may be embedded into a pavement striping to increase light reflectivity in order to make the pavement striping more visible in darkness. As an example, reflective beads such as glass spheres have been applied to pavement striping when it the striping is still in a molten state. The beads that are used to reflect light may be translucent and therefore retroreflective, or the beads may be formed of reflective material. This is effective particularly when the beads are elevated above the pavement surface so that they are not submerged in wet conditions. However, merely embedding retroreflective beads in pavement striping fails to produce a sufficient audible vibration from the striping when a vehicle crosses over the striping.

As another example, reflective markers, such as those described in U.S. Pat. No. 3,418,896 to Rideout, have been embedded into molten pavement striping. Rideout discloses reflective markers that produce rumbles or bumps when vehicle wheels roll over them. The markers of Rideout have flat upper and lower surfaces and vertical side walls coated with glass spheres. The upper flat surface of the marker is not reflective. When the glass spheres wear off of the side walls, the marker loses its reflectivity and must be replaced. Although Rideout discloses dropping his markers "onto a tacky binder layer with one of the flat sides down," Rideout fails to disclose a method or an apparatus for dispensing the markers automatically.

U.S. Pat. No. 4,279,534 to Eigenmann discloses a method and apparatus for applying asymmetrical retroreflective elements to a carrying layer such as a traffic paint film. However, Eigenmann fails to teach a method for applying pavement markers of a larger size to molten pavement striping while avoiding the undesirable defects in the base line material that can occur at higher application speeds. For example, a straight drop of a pavement marker from a vehicle traveling at or above 3 miles per hour (mph) can result in skidding of the marker, which forms a puddle in the base line material. Even at speeds as slow as 1 mph and assuming an effectively disc-shaped marker, if the front, or leading, edge of the marker hits the base line first, the marker tends to flip upside down due to the combination of forces applied by the striping to the marker. Alternatively, if the marker is dropped with too great of a rearward tilt, the marker might bounce, leaving a divot in the base line, and might flip over. My invention includes a pavement marker constructed of material capable of partially melting and fusing with a molten highway striping.

Thus, this invention addresses the inadequacies of the prior art described above and provides improved pavement markers for the audible and retroreflective marking of highways, and the apparatus and process of applying the markers to pavement striping on highways.

SUMMARY OF THE DISCLOSURE

The method, apparatus and product disclosed herein provide improved road striping for highways over which vehicles pass, including pavement markers in the road striping that are reflective and produce an audible vibration when driven over.

One form of the disclosure is a pavement marker for the marking of the surface of paved highways formed of a molded mixture comprising light reflective beads and a binder. The pavement marker includes a base surface that becomes the bottom surface for facing downwardly in the road striping, an opposed surface that becomes the top surface for protruding upwardly from the road striping, and a side surface intersecting the base surface and opposed surface. The base surface is effectively flat and has a greater breadth than the opposed surface. The side surface is sloped with respect to the opposed surface at an angle to produce an audible vibration when a wheel of a vehicle engages the opposed surface of the pavement marker. The pavement marker is characterized by some of the light reflective beads being partially embedded in the binder and partially exposed on the opposed surface and on the side surface for reflecting light from the vehicle, and keeping the binder layers from sticking together when stacked, and others of the light reflective beads are totally embedded in the binder material. As the binder material and reflective beads wear away from the opposed and side surfaces of the pavement markers, some of the light reflective beads that were totally embedded in the binder of the pavement marker will become exposed for reflecting light from the vehicle.

A method disclosed herein is a method for forming highway markings on a paved highway. The highway markings include a base line and reflective pavement markers applied at intervals to the base line. The pavement markers have an effectively flat base surface and an opposed surface. The method may include the following steps. A carrier is advanced in a forward direction along the highway at a predetermined speed in a forward direction. Liquid striping material is applied from a liquid applicator mounted on the carrier to the paved highway to form the base line on the highway. A pavement marker is tilted so that the base surface of the pavement marker is in a tilted attitude and faces in the forward direction. Then the pavement marker is moved along a sloped path directed rearwardly of the forward direction while the base surface of the pavement marker is still in its tilted attitude and facing the forward direction. The pavement marker is applied to the base line, and the pavement marker is tilted back to horizontal as it is applied to the base line so that its base surface is horizontal and embedded as the bottom surface in the molten pavement marking.

Another feature of this disclosure is an apparatus for forming highway markings including a base line and light reflective pavement markers spaced along said base line. The apparatus includes a carrier for moving along a highway surface in a forward direction. The apparatus may include a liquid applicator mounted on the carrier configured to apply a base line of molten thermoplastic pavement marking to the highway surface. The apparatus further comprises a dispenser for dispensing the pavement markers onto the base line. The dispenser may include a hopper configured to hold a supply of the pavement markers in an upwardly extending stack of the pavement markers. A chute is sloped downwardly from the supply of pavement markers and rearwardly from the forward direction of movement of the carrier for receiving the pavement markers and moving the pavement markers toward the base line when applied to the highway surface. A pusher may be used for moving a pavement marker from the supply of pavement markers onto the chute.

Another form of the disclosure is a mobile highway marking apparatus for advancing in a forward direction along a paved surface of a highway for applying a base line to the paved surface and applying pavement markers at intervals on the base line. The pavement markers each may include opposed substantially parallel base and opposed surfaces. The marking apparatus includes a paint applicator for progressively applying the base line to the paved surface of the highway as the marking apparatus advances. The marking apparatus further includes a dispenser carried by the marking apparatus for intermittently applying the pavement markers at intervals to the base line that was applied to the paved surface. The dispenser may be configured for moving a sequence of the pavement markers from the bottom of an upwardly extending stack of the pavement markers down a sloped chute in a direction opposite to the forward direction of movement of the highway marking apparatus to the base line without turning the pavement markers over.

Other objects, features and advantages of the present disclosure will become apparent upon reading the following specification, taken in conjunction with the accompanying drawings.

DETAILED DESCRIPTION

Referring now in more detail to the drawings, in which like numerals indicate like parts throughout the several views, FIGS. 1-6 illustrate examples of a pavement marker according to various embodiments. The pavement marker is adapted to be applied to a molten base line of highway striping at intervals, thereby becoming embedded into the base line. In a preferred embodiment, the material of the pavement marker partially melts due to the temperature of the molten base line, fusing the pavement marker to the base line. The pavement marker may be designed to be retroreflective and to produce an audible vibratory effect in a vehicle when a wheel of the vehicle engages the pavement marker. FIGS. 10-12 and 15 illustrate a method and apparatus for dispensing the pavement markers accurately while traveling at acceptable application speeds of about 3 to 5 miles per hour, without causing undesired effects in the base line material.

Figure 1:
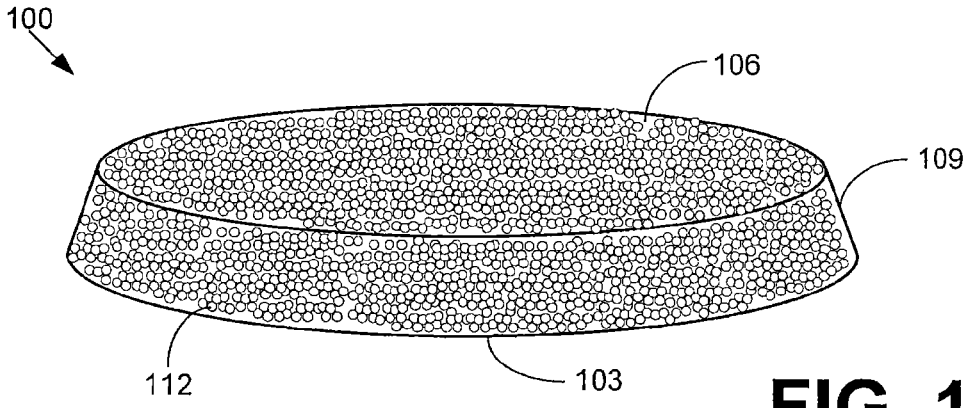
FIG. 1 is a perspective view of a pavement marker according to one embodiment.
Figure 4:
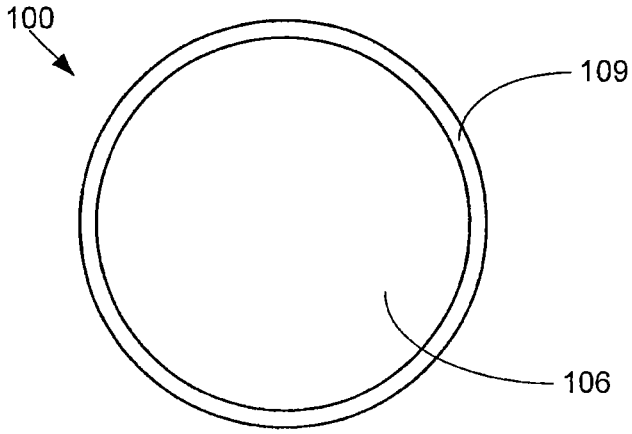
FIG. 4 is a top view of the pavement marker of FIG. 1.
Figure 5:
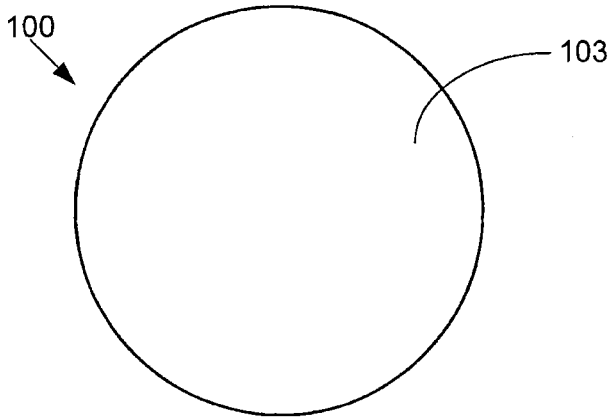
FIG. 5 is a bottom view of the pavement marker of FIG. 1.
Figure 6:
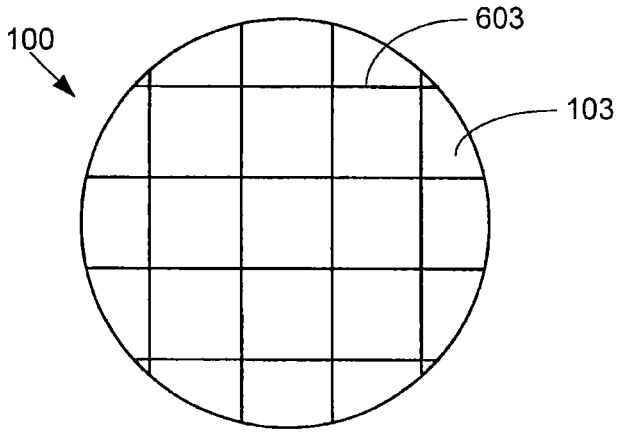
FIG. 6 is a bottom view of the pavement marker of FIG. 1 having a grooved texture applied to the base surface according to another embodiment.

With reference to FIG. 1, a pavement marker 100 has a base surface 103, an opposed surface 106, and a side surface 109. The opposed surface 106 and the side surface 109 of pavement marker 100 support partially exposed light reflective beads 112. The pavement marker 100 is formed of a molded mixture comprising light reflective beads 112, a binder, and other materials. Light reflective beads 112 may comprise, for example, glass spheres such as AASHTO M-247 specification retroreflective beads, though a wide variety of sizes and refractive indexes of glass spheres could be used. As depicted in FIGS. 4-6, in a preferred embodiment, the base surface 103 and the opposed surface 106 have a circular shape, giving the pavement marker 100 an overall disc-like shape. A circular shape has been selected for its simplicity and ability to reflect omni-directionally when put into service, although it is understood that other shapes, such as polygons or domes also may be used.

Figure 2:
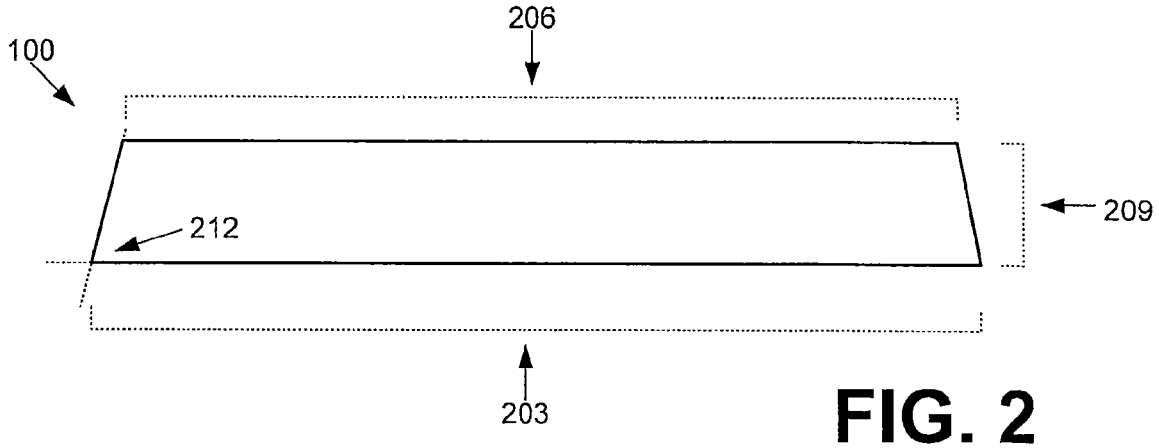
FIG. 2 is a side view of the pavement marker of FIG. 1.

FIG. 2 is a side view of the pavement marker 100. The pavement marker 100 has a base surface diameter 203, an opposed surface diameter 206, a thickness 209, and a wall angle 212. In a preferred embodiment, the base surface diameter 203 is between 3 and 3.25 inches, which has excellent audibility and visibility characteristics and fits within the four-inch wide base lines most commonly used in highway striping in the United States. In a preferred embodiment, thickness 209 will be one-half inch, which meets specifications for audible pavement markings in Florida, South Carolina, and other states. It is to be understood, however, that the base surface diameter 203 and thickness 209 are nominal values and other sizes may be used as appropriate.

In a preferred embodiment, the wall angle 212 is 75 degrees. Wall angles 212 from 35 to 80 degrees may be used, and steeper angles are correlated with sharper audible sounds and a more intense vibratory effect. A steeper angle also provides better wet reflectivity for the light reflective beads 212 on the side surface 109. However, with a wall angle 212 above 75 degrees, the tire impact point on opposed surface 106 and side surface 109 will have less support and may wear more quickly and/or be more likely to fracture. A wall angle 212 of 75 degrees is associated with an audible vibration having an intensity of at least 100 decibels when the vehicle is traveling at or above 55 mph.

The opposed surface diameter 206 may be determined from the thickness 209, the base surface diameter 209, and the wall angle 212. Preferably, the opposed surface 106 is substantially flat with light reflective beads 112 protruding from the flat opposed surface 106. But other shapes may be used.

Figure 9:
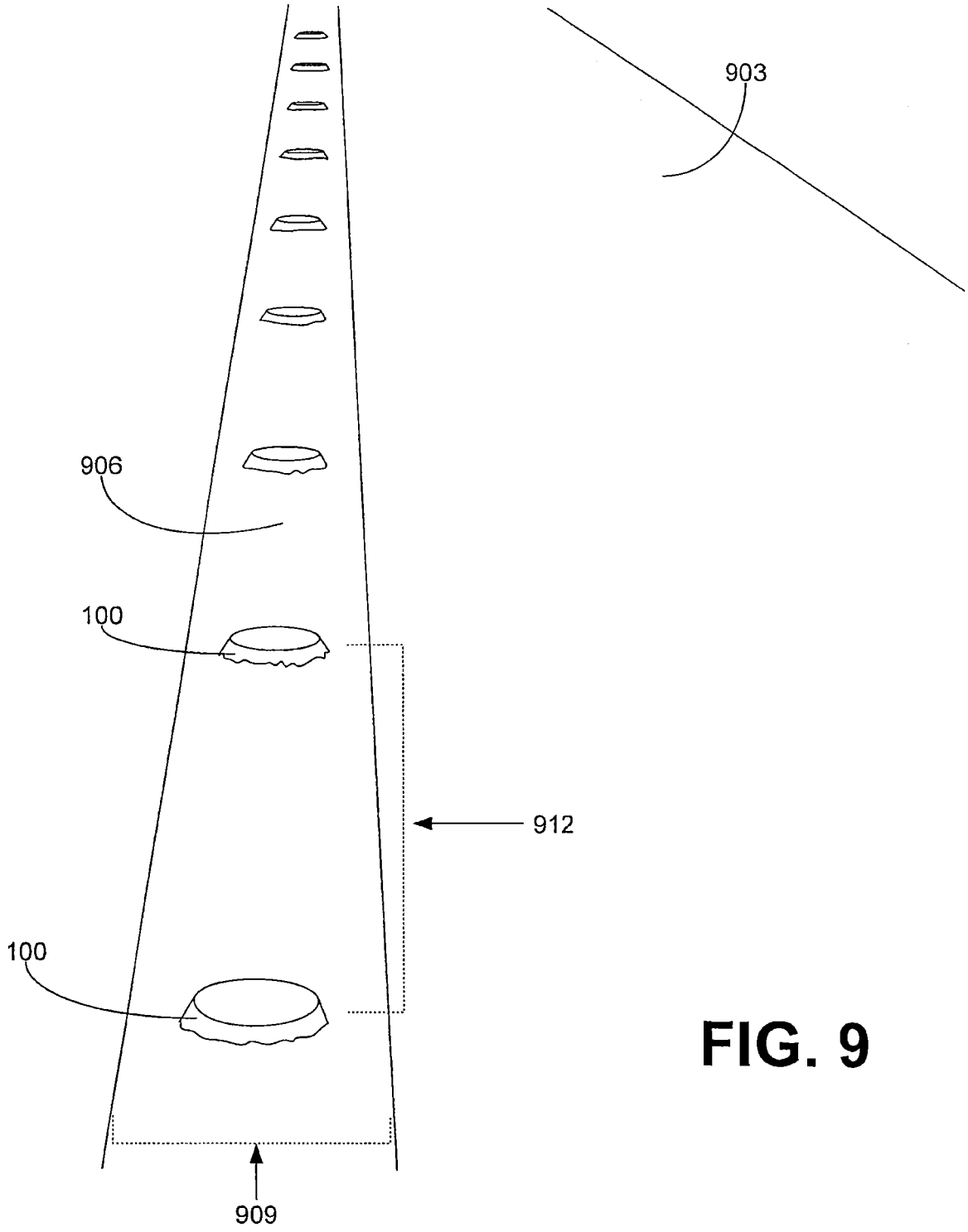
FIG. 9 is a perspective view of a highway surface having a base line and a plurality of pavement markers embedded into the base line.

The side surface 109 of the pavement marker 100 forms an acute angle with the base surface 103 that helps to anchor the pavement marker in the base line 906, as shown in FIG. 9.

Figure 3:
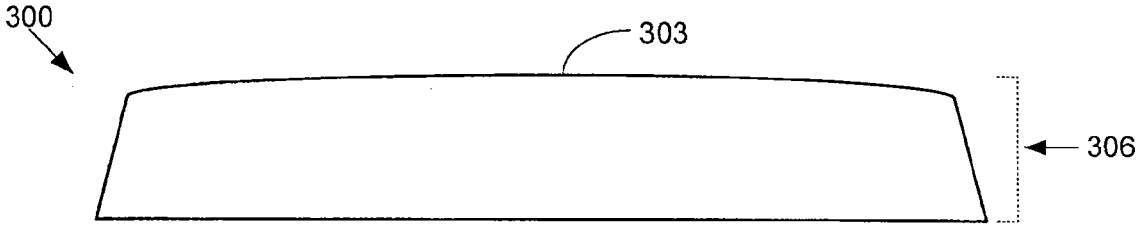
FIG. 3 is a side view of a dome-shaped pavement marker according to another embodiment.

FIG. 3 depicts a pavement marker 300 wherein the opposed surface 303 has a convex dome shape. The pavement marker 300 also has a dome thickness 306. A slight dome shape provides a larger surface area on opposed surface 303 when compared to opposed surface 106, and a larger surface area provides better wet retroreflectivity. However, pavement marker 300 may consume more material. Additionally, pavement markers 300 may be more difficult to stack and have less support when stacked, leading to potential breakage.

FIG. 4 shows a top view of the pavement marker 100. The light reflective beads 112 have been omitted for clarity. FIG. 5 shows a bottom view of the pavement marker 103, wherein the base surface 103 is substantially free of protruding light reflective beads 112 and is effectively flat. By contrast, FIG. 6 illustrates a bottom view of the pavement marker 103, wherein the base surface 103 has a surface texture 603. In this embodiment, surface texture 603 comprises groves that have been cut or stamped into the base surface 103. Surface texture 603 may also comprise dimples or other surface features. Although not essential, surface texture 603 may aid in keeping the pavement marker 100 secured in the base line material by allowing the pavement marker 100 to settle further into the base line material. It is preferred that the base surface be effectively flat, generally without a surface shape that tends to cause the pavement marker to flip or to roll over when being applied to the highway striping or when being dispensed. Also, the effectively flat base surface 103 of the pavement markers 100 allows the lowermost pavement markers in an upwardly extending stack to move laterally from the bottom of the stock with a minimum of friction.

Figure 7:
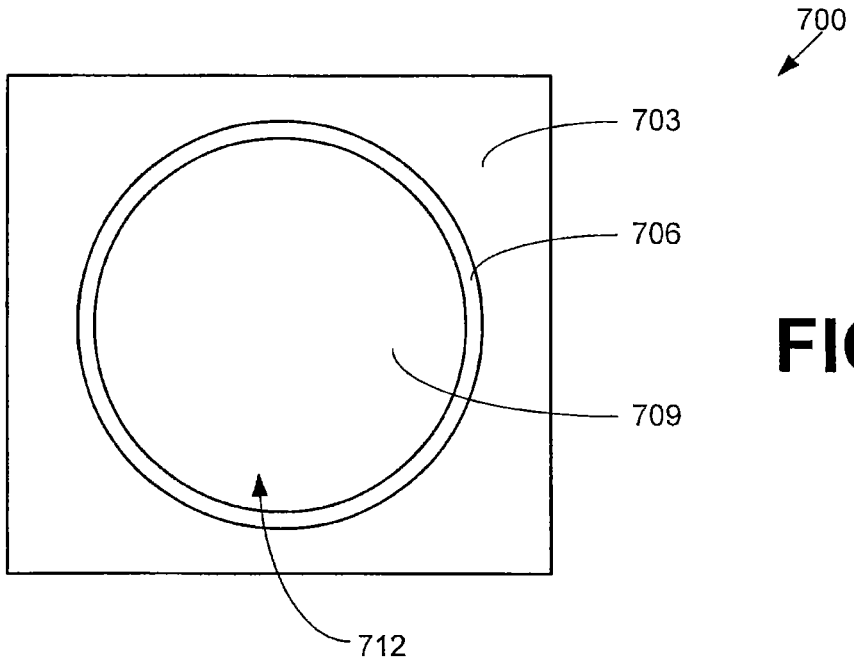
FIG. 7 is a top view of a mold used to form the pavement marker of FIG. 1 according to one embodiment.
Figure 8:
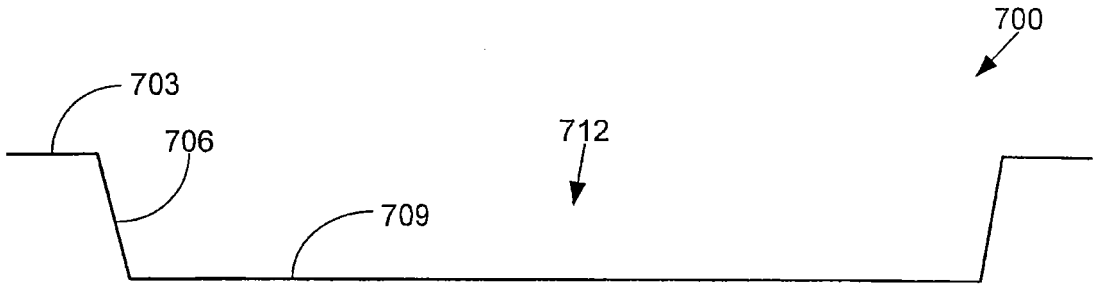
FIG. 8 is a side cross sectional view of the mold of FIG. 7.

FIGS. 7-8 show one example of a mold used in forming pavement markers 100 according to various embodiments. FIG. 7 illustrates a top view of a mold 700, while FIG. 8 illustrates a side cross sectional view of the mold 700. The mold 700 has an upper surface 703, a wall surface 706, and a lower surface 709, the surfaces together forming a cavity 712. Mold 700 may be formed out of metal, such as steel or aluminum, by machining or stamping into the desired shape. Also, molds may be made by pressing the shape into a mixture of glass beads themselves held in place by a small amount of tackifier, film former, or water.

The mold 700 is prepared by first spraying with a solution comprising, for example, five grams of surfactant and ten grams of polyvinyl alcohol per liter. The surfactant functions to reduce surface tension of the water to allow for an even coating. Reflective beads, such as light reflective beads 112, are applied to the mold 700 and cling to the wet surfaces of the mold 700. Upon drying, the polyvinyl alcohol in the solution forms a film that holds the reflective beads to the wall surface 706 and the lower surface 709 of the mold 700. Accordingly, the reflective beads become the light reflective beads 112 of the pavement marker 100 and also prevent the pavement marker 100 from sticking in the mold 700.

In various embodiments, the material used in formulating the pavement marker 100 may be similar to that used in the base line in order to ensure proper fusion of the pavement marker 100 with the molten base line. However, pavement markers 100 may be formulated with a higher content of a copolymer, such as ethylene vinyl acetate, to improve toughness and reduce the likelihood of fracture during shipping or application. It may further be desired to raise the softening point slightly to prevent deformation of the pavement marker 100 in extremely hot weather. By using reflective beads within the formulation as well as to coat the cavity 712, once the light reflective beads 112 wear off of the opposed surface 106 and side surface 109 of the pavement marker 100, others of the light reflective beads 112 that were initially totally embedded will become exposed when the binder material wears away.

The following is an example formulation of base line material compared with an example formulation of pavement marker 100 material:

Example Base Line Formulation:

| | |
|---|---|
| Maleic modified glycerol ester of rosin | 17% |
| Titanium dioxide pigment | 10% |
| AASHTO M-247 glass spheres | 40% |
| Calcium carbonate filler | 29.5% |
| Ethylene vinyl acetate copolymer | 1% |
| Long alkyd oil plasticizer | 2.5% |
| Resulting softening point: | 100 C. |

Example Pavement Marker Formulation

| | |
|---|---|
| Maleic modified glycerol ester of rosin | 17% |
| Titanium dioxide pigment | 10% |
| AASHTO M-247 glass spheres | 40% |
| Calcium carbonate filler | 28% |
| Ethylene vinyl acetate copolymer | 5% |
| Long alkyd oil plasticizer | 2% |
| Resulting softening point: | 128 C. |

The pavement marker 100 formulation, such as that given above, is blended and heated to 420 degrees Fahrenheit, or some other temperature, where it liquefies to a syrup-like consistency. The thermoplastic formula is then poured into the cavity 712 of the mold 700 at a rate that will not disturb the coating of reflective beads until the cavity 712 is full. The material quickly solidifies as it cools. Within about 10 minutes, the pavement marker 100 is cool enough to handle, and the mold 700 may simply be inverted to remove the pavement marker 100 from the cavity 712.

It is understood that other processes may be used to manufacture pavement markers 100. Additionally, alternative chemistries, such as hydrocarbon-based formulations, may be used.

FIG. 9 shows a perspective view of a highway surface 903 having a base line 906, the base line 906 having a base line width 909. A plurality of pavement markers 100 are embedded into the base line 906 at intervals 912. The interval 912 may be, for example, 30 inches, 24 inches, or other distances as may be desired. The base line width 909 may be four inches or some other width as desired. The base line 906 may be any commercially available, preferably thermoplastic, highway marking material, such as Tuffline Alkyd or Ecotherm Alkyd available from Crown Technology, LLC, in Woodbury, Ga. The base line 906 may be applied at a thickness of, for example, 0.10 to 0.11 inches.

Figure 10:
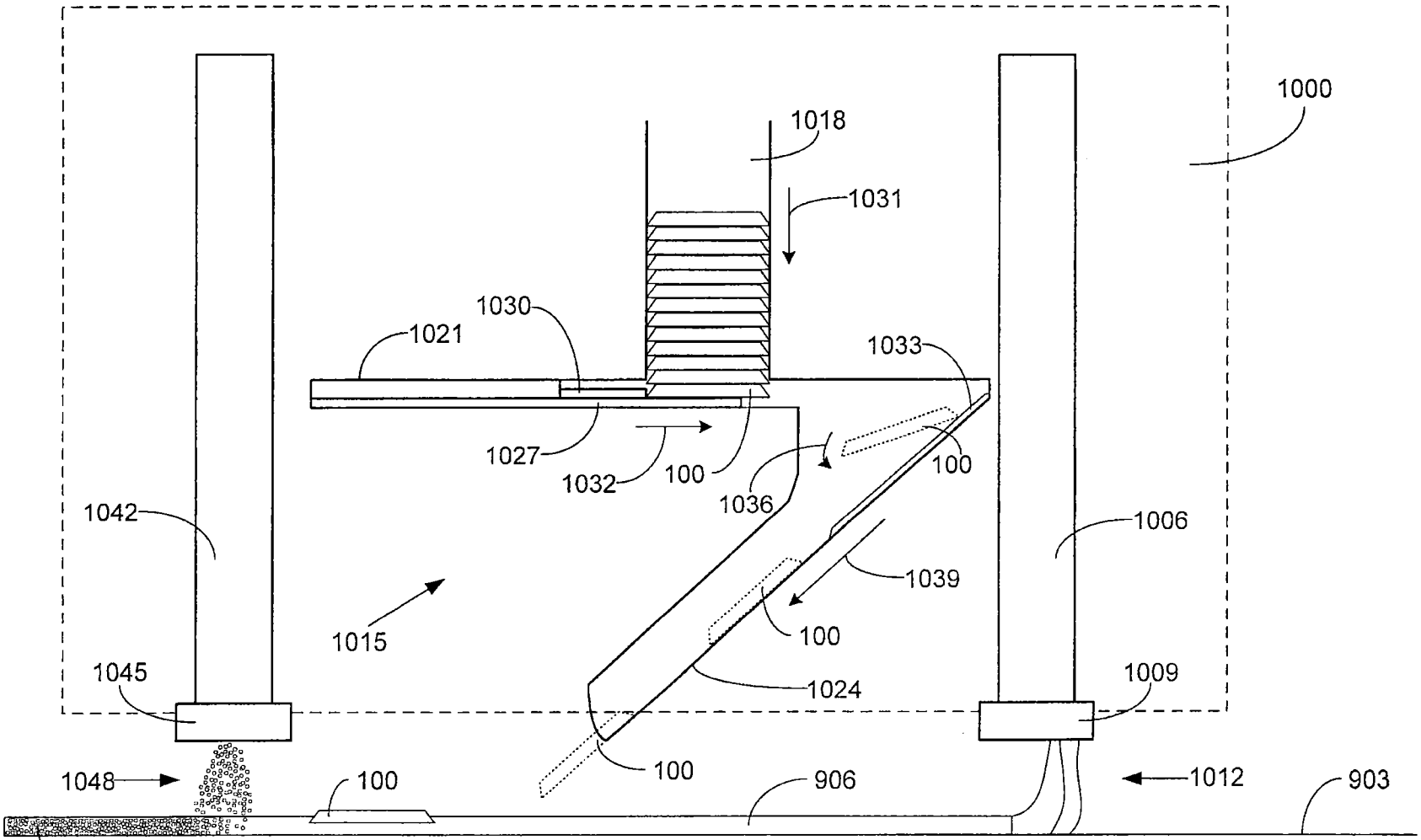
FIG. 10 is a side elevational schematic view of the method and apparatus for forming the base line and dispensing the pavement markers.
Figure 11:
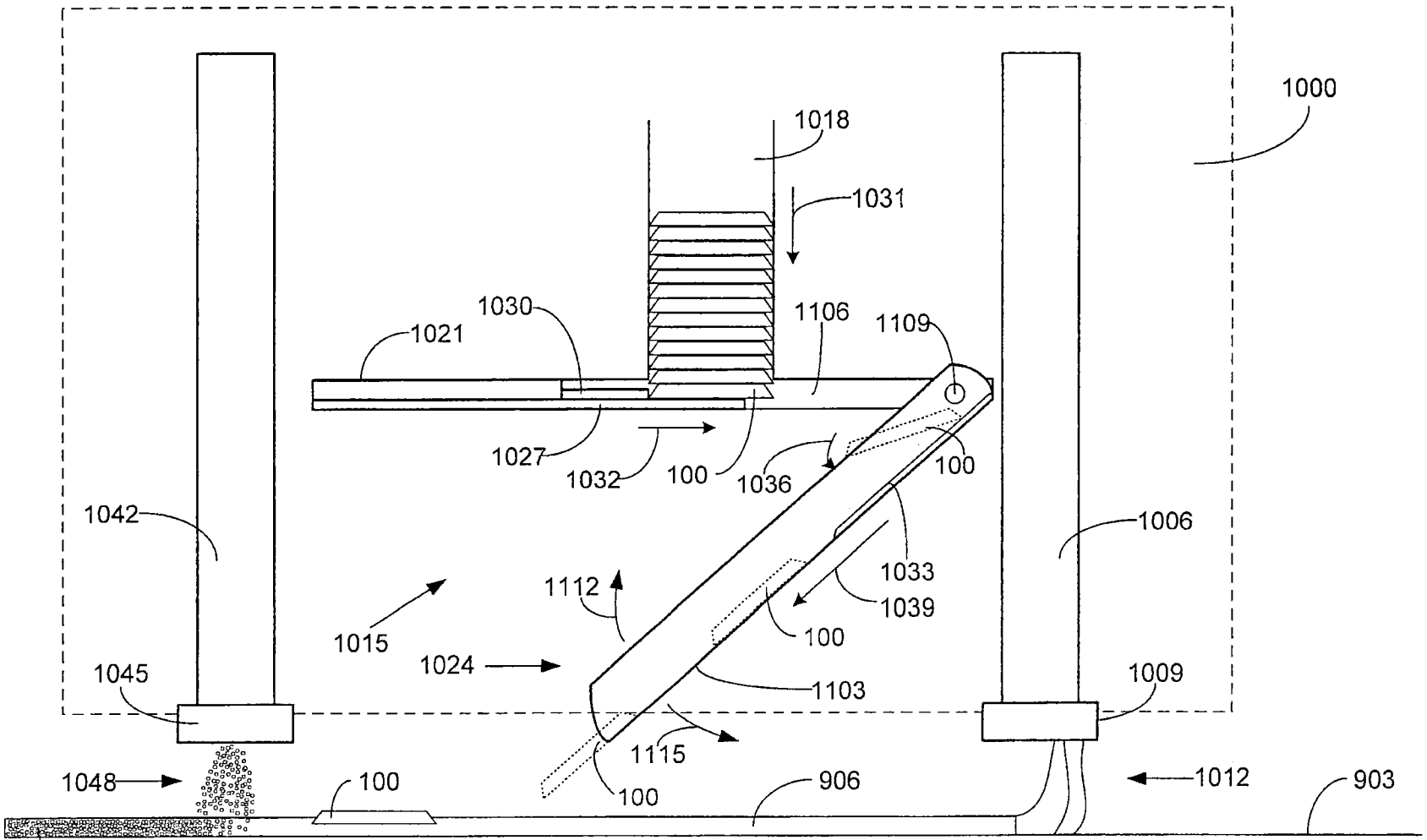
FIG. 11 is the side elevational schematic view of FIG. 10. depicting a delivery chute having an adjustable slope.
Figure 12:
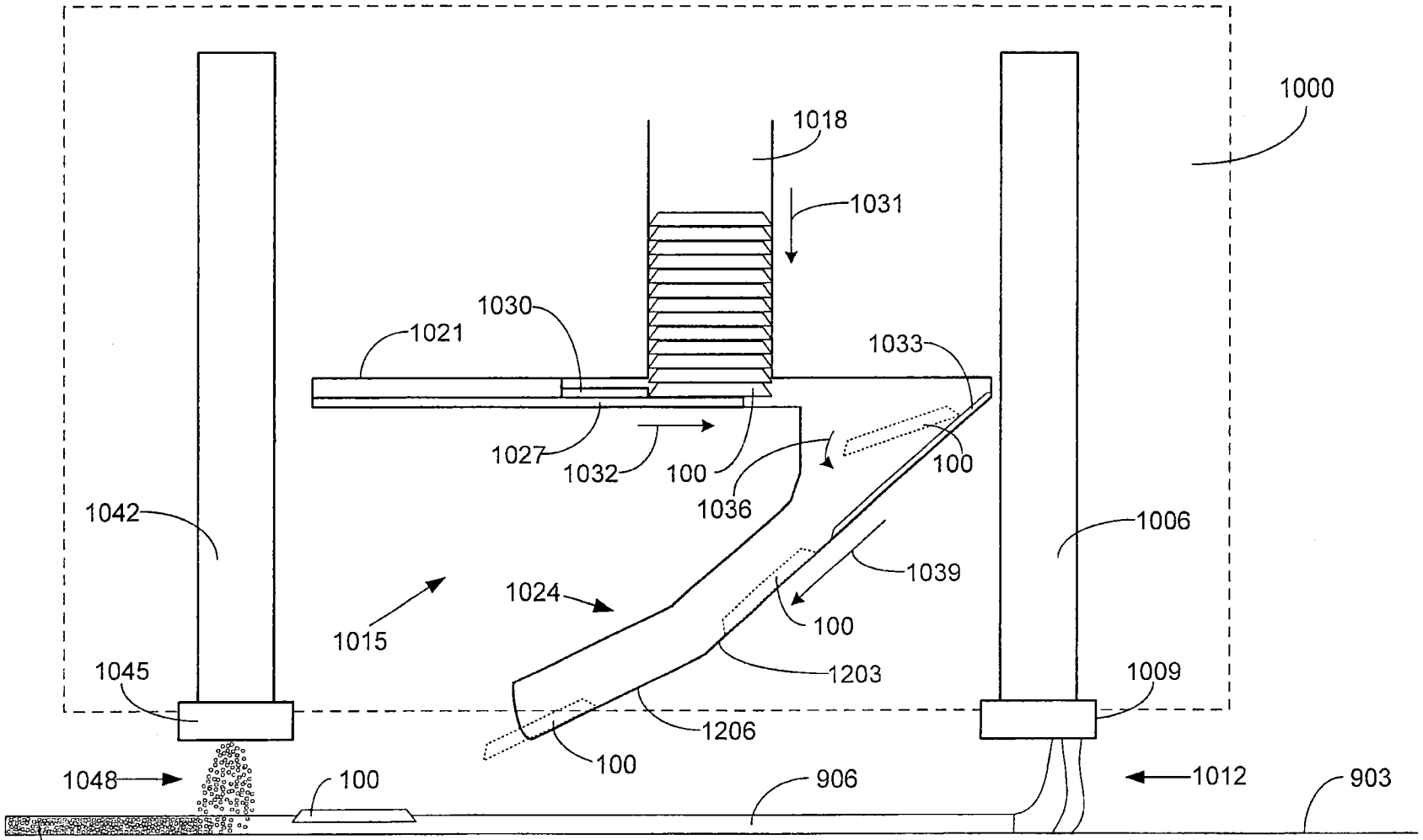
FIG. 12 is the side elevational schematic view of FIG. 10. depicting a delivery chute having a varied angle of descent.

Referring now to FIGS. 10-12, shown are side elevational schematic views of the method of forming the base line 906 and dispensing the pavement markers 100. Carrier 1000 comprises a commercially available single vehicle, such as a truck manufactured by Mark Rite Lines in Billings, Mont., Model 4-4000-DP, that is advanced along the highway surface 903 in the direction as indicated by arrow 1003.

A liquid applicator 1006 having a spray head 1009 is mounted to the carrier 1000. As the carrier 1003 advances, the liquid applicator 1006 applies thermoplastic paint 1012 to the highway surface 903 through the spray head 1009. The thermoplastic paint 1012 comprises thermoplastic pavement marking material that has been heated to a molten state at between 400 and 425 degrees Fahrenheit. It is understood that different paint materials may require different application temperatures. Furthermore, although the term "paint" is used, "paint" is understood herein to refer to any type of pavement marking material. After application, thermoplastic paint 1012 forms the base line 906 for the highway striping.

Also mounted to the carrier 1000 is a pavement marker dispenser 1015. In this embodiment, the pavement marker dispenser 1015 comprises an upwardly extending hopper 1018, a disc actuator 1021, and a delivery chute 1024. The hopper 1018 holds an upwardly extending stack of the pavement markers 100, the stack being supported by a supporting surface 1027. The disc actuator 1021 is configured to deliver pavement markers 100 to the delivery chute 1024 at predetermined time intervals based on the speed of the carrier 1000. Thus, the disc actuator 1021 may be controlled by a commercially available skip timer.

In the embodiment of FIGS. 10-12, the disc actuator 1021 includes a pushing means 1030 for directing the lowermost pavement marker 100 in the hopper 1018 laterally along the supporting surface 1027 in the direction of movement of the carrier 1000 to the delivery chute 1024. The pushing means 1030 may comprise, for example, an air-actuated sliding shoe. In other embodiments, the disc actuator 1021 may comprise, for example, a rotating helical surface configured to support the stack of pavement markers 100 in the hopper 1018 and to rotate to allow a pavement marker to drop down and be received by the delivery chute 1024. Other mechanisms may be appreciated for supporting the stack of pavement markers 100 and releasing one of the stack into the delivery chute 1024. Upon release of a pavement marker 100, the stack in the hopper 1018 advances downward in the direction of arrow 1031.

The pavement markers 100 are to be loaded in the upwardly extending hopper 1018 with their effectively flat base surfaces facing down toward engagement with the upwardly facing opposed surfaces of the pavement markers next below. By the operation of the pushing means 1030, the pavement markers 100 are given a forward velocity in the direction of arrow 1032 and are received by the delivery chute 1024. The pavement marker dispenser 1015 is designed to keep the pavement marker 100 positioned with its effectively flat base surface 103 in contact with the parts of the pavement marker dispenser 1015, and, in particular, delivery chute 1024. Such positioning tends to avoid abrasive wear that might be caused by the light reflective beads 112 engaging the delivery chute, thereby prolonging the life expectancy of the pavement marker dispenser 1015.

Since the upwardly facing opposed surfaces of the pavement markers in the hopper engage the effectively flat base surfaces of the pavement marker next above, the frictional resistance applied to the lowermost pavement marker during lateral movement from beneath the stack is minimized.

In some embodiments, the delivery chute 1024 may be equipped with a damper 1033 to dampen the impact of the pavement marker 100 at the surface of the delivery chute 1024 and to reduce bouncing of the pavement marker 100 when applied at a high rate of speed. Bouncing of the pavement marker 100 may lead to imprecise placement into the molten base line 906. The damper 1033 may comprise, for example, rubber bushings or a surface affixed to the delivery chute 1024 by a flexible material, such as silicone or foam.

When the pavement marker 100 engages the delivery chute 1024 or damper 1033, the gravitational force pulls the pavement marker 100 downward as shown by arrow 1036. While sliding down the delivery chute 1024 in the direction of arrow 1039, the pavement marker 100 gains a horizontal component of velocity in the direction rearward of the movement of the carrier 1000. Accordingly, when released by the delivery chute 1024 for embedding into the base line 906, the pavement marker 100 has a forwardly directed component of velocity less than that of the carrier 1000. Preferably, the pavement marker 100 will have a forwardly directed component of velocity less than 1 mph when the pavement marker 100 contacts the molten base line 906. By having a net forward ground speed less than that of the carrier 1000, surfing and skidding of the pavement marker 100 on the base line 906 are reduced.

When the pavement marker 100 is released from the delivery chute 1024, the base surface 103 is sloped facing downwardly and forwardly of the pavement marker dispenser 1015. A slight tilt of between 20 and 35 degrees helps to prevent a number of defects from occurring. For example, if the forwardly facing side surface 109 were to hit the base line 906 first, the pavement marker 100 may flip upside down due to the combination of forces applied to the pavement marker 100. However, too much tilt, e.g., greater than 40 degrees, may cause the pavement marker 100 to bounce, leaving a divot in the base line 906, and may cause the pavement marker 100 to flip over.

The angle of the delivery chute 1024 may be selected based on the desired speed of the carrier 1000. For example, the carrier 1000 may be moving at a speed of between 2 and 7 mph. It has been observed that highway striping crews prefer to apply pavement markings at a speed of between 3 and 5 mph. Therefore, the length and angle of the delivery chute 1024 and the corresponding rearward velocity may be fixed for the common case, as depicted in FIG. 10. Alternatively, as depicted in FIG. 11, the angle of the delivery chute 1024 may be adjustable. The delivery chute 1024 may have a slide portion 1103 connected to an upper portion 1106 by means of a hinge 1109. Therefore, the angle of descent may be varied by moving the slide portion 1103 in the direction of arrows 1112 or 1115. Additionally, the length of the delivery chute 1024 may be adjustable in some embodiments. In various embodiments, a change in the angle or length of the delivery chute 1024 may be partially or fully automated based on the speed of the carrier 1000.

The delivery chute 1024 of FIG. 12 exhibits a varied angle of descent by having a first slope 1203 and a second slope 1206. As shown, the first slope 1203 has a steeper angle of descent than the second slope 1206, but the opposite may be the case in other embodiments. Alternatively, the change in slope may be graduated, producing a curved delivery chute 1024.

Figure 13:
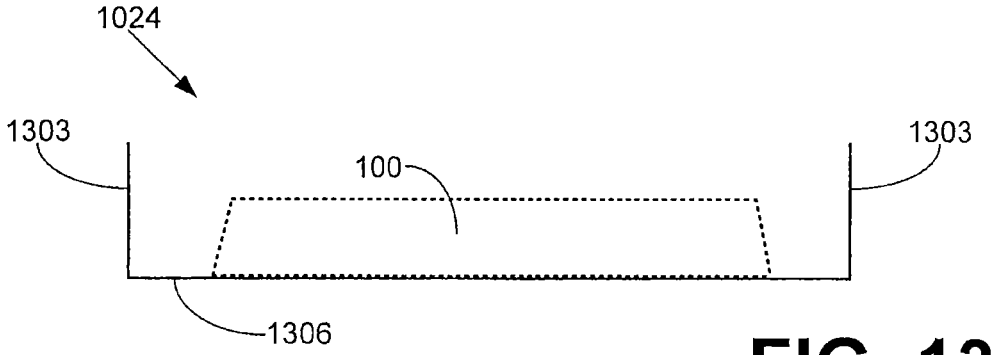
FIG. 13 is a cross sectional view of a delivery chute according to one embodiment.
Figure 14:
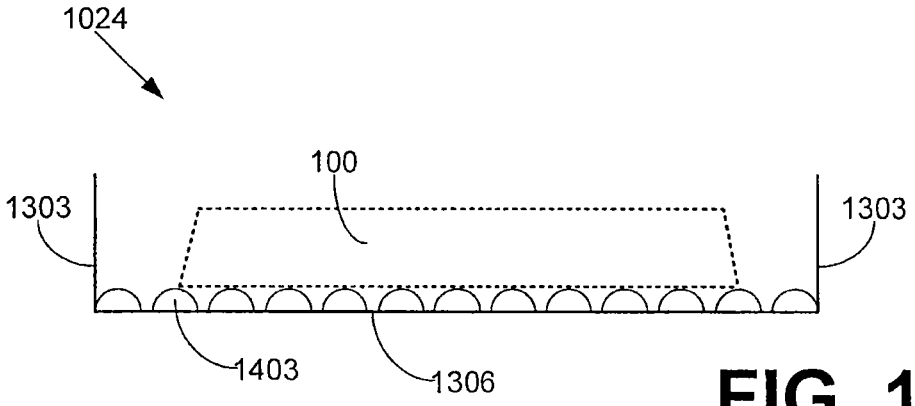
FIG. 14 is a cross sectional view of a delivery chute having a plurality of longitudinal ribs according to one embodiment.

Referring next to FIGS. 13-14, shown are cross sectional views of the delivery chute 1024 according to various embodiments. In particular, the delivery chute 1024 has two side walls 1303 and a sliding surface 1306. The walls 1303 and/or the sliding surface 1306 may be constructed of plastic, metal, and/or other suitable material. The size and configuration of the walls 1303 and sliding surface 1306 as depicted is merely one example of walls 1303 and a sliding surface 1306, and the dimensions may vary as desired depending on the pavement marker 100 and other factors. The sliding surface 1306 may be flat as shown in FIG. 13 or, alternatively, may have a plurality of longitudinal ribs 1403 as shown in FIG. 14. The plurality of longitudinal ribs 1403 may be used to reduce the surface area in contact with the pavement marker 100, thereby reducing friction. The quantity and configuration of the plurality of longitudinal ribs 1403 are presented only as one example of such a friction reducing configuration.

Referring back to FIGS. 10-12, the pavement marker dispenser 1015 and the delivery chute 1024 are positioned on the carrier 1000 and configured so that the pavement marker 100 is released to the molten base line 906 as close to the spray head 1009 as possible, preferably within 10 inches of the spray head 1009. This positioning is desired because the thermoplastic paint 1012 cools very rapidly and the molten base line 906 needs a sufficiently high temperature to produce a bond between the pavement marker 100 and the molten base line 906. Preferably, the temperature of the molten base line 906 will be sufficiently high to partially melt the material of the pavement marker 100 so that the partially melted pavement marker 100 will fuse with the molten base line 906.

As shown in FIGS. 10-12, a reflective bead applicator 1042 having a dispensing head 1045 may be mounted to the carrier 1000. The reflective bead applicator 1042 releases light reflective beads 1048 through the dispensing head 1045 onto the molten base line 906. The light reflective beads 1048 may be the same as or different from the light reflective beads 112 used in the manufacture of the pavement markers 100. The light reflective beads 1048 thereby become embedded into the molten base line 906 with embedded pavement markers 100, producing a reflective base line 1051.

Figure 15:
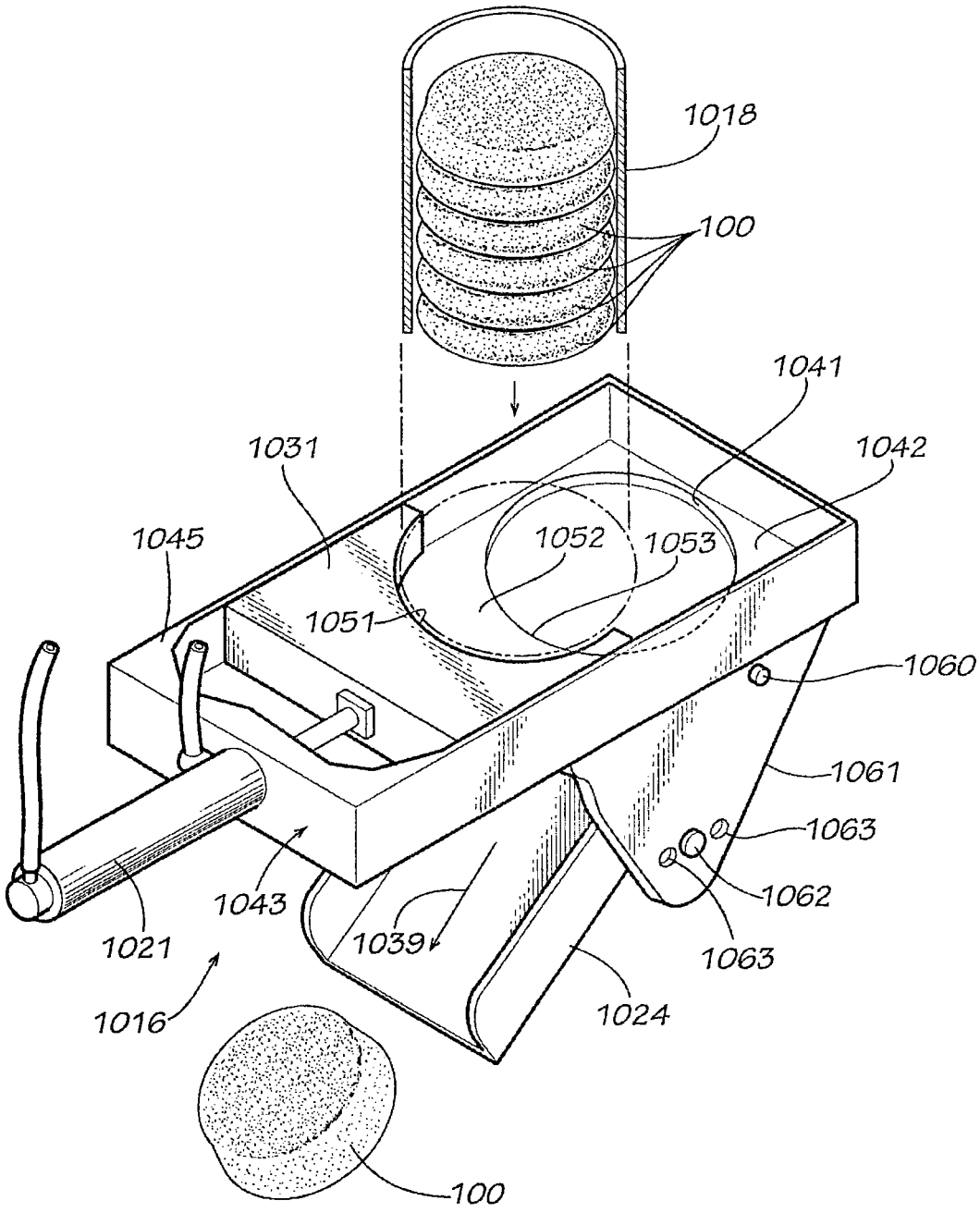
FIG. 15 is a perspective view of a dispenser of the apparatus for forming a base line on a paved surface. The top wall of the dispenser housing is broken away to expose the interior of the housing and the hopper is expanded above the housing.

FIG. 15 is a perspective view of a modified pavement marker dispenser 1016. It includes a modified pusher 1031 that is actuated by pneumatic cylinder 1021 to push the lower most disk-shaped pavement marker 100 from the vertical stack of pavement markers in the hopper 1018 to the discharge opening 1041 in the bottom wall 1042 of the dispenser housing 1043.

The pusher 1031 may include a concave pushing surface 1051 that has a radius of curvature that substantially matches the radius of curvature of discharge opening 1041. When the pusher 1031 is retracted away from the discharge opening 1041 by pneumatic cylinder 1021, a shelf 1052 having a curved edge 1053 is formed by the bottom wall 1042. The hopper 1018 is mounted to the top wall 1045 in alignment with the shelf 1052 and the concave pushing surface 1051 of the pusher 1031. With this arrangement, the hopper 1018 guides the pavement markers 100 downwardly under the influence of gravity until the lowermost pavement marker rests on the shelf 1052.

When the lowermost pavement marker 100 is to be dispensed, the pneumatic control system (not shown) actuates pneumatic cylinder 1021, causing the disk pusher 1031 to move forwardly beneath the hopper 1018 so that its concave edge 1051 engages the lowermost pavement marker, pushing the pavement marker that is resting on the shelf 1052 into registration with the discharge opening 1041. This causes the lowermost pavement marker to fall through the discharge opening 1041, where it engages the delivery chute 1024, sliding down the delivery chute as indicated by arrow 1039, as described before.

The thickness of the pusher 1031 is less than the thickness of the pavement markers 100 so that the next oncoming pavement marker tends to engage the top surface of the pusher 1031 when the pusher 1031 has just discharged the previous pavement marker through the discharge opening 1041. When the pneumatic control system reverses the pneumatic cylinder 1021 to withdraw the pusher 1031 away from the discharge opening 1041 and back into alignment with the hopper 1018, the pavement marker that is now lowermost in the hopper 1018 will move downwardly to rest on the shelf 1052, in proper position for the next cycle of the dispenser.

The placement of the discharge opening 1041 close to the pusher 1031 reduces the longitudinal length of the dispenser 1015.

In order to vary the velocity of the pavement markers 100 exiting the dispenser, the delivery chute 1024 may be pivoted about its pivot pins 1060 that extends through the side aprons 61 that straddle the delivery chute 1024. Positioning pins 1062 extend through one of the openings, such as opening 1063, to extend behind the delivery chute 1024, thereby supporting the delivery chute at a desired angle with respect to the pivot pin 1060.

Although preferred embodiments of the invention have been disclosed in detail herein, it will be obvious to those skilled in the art that variations and modifications of the disclosed embodiments can be made without departing from the spirit and scope of the invention as set forth in the following claims.

The invention claimed is:

1. An apparatus for forming highway striping including a base line and light reflective pavement markers spaced along the base line, comprising:

a carrier for advancing along a highway surface in a forward direction, a liquid applicator mounted on said carrier configured to apply the base line of molten thermoplastic pavement marking on the highway surface as said carrier is moved along the highway surface in a forward direction, a dispenser for dispensing the pavement markers onto the base line, said dispenser positioned behind said liquid applicator, said dispenser including a hopper configured to hold a plurality of the pavement markers in an upwardly extending stack of the pavement markers, a chute positioned behind said liquid applicator and sloped downwardly beneath said hopper and extending rearwardly from the forward direction of movement of the carrier for receiving the pavement markers from said hopper and sliding the pavement markers under the influence of gravity down the rearward slope of said chute and toward said base line for application to the highway surface, and a pusher for moving the lowermost pavement marker in the stack of pavement markers from said hopper in a forward direction onto said chute, such that the pavement markers move on said sloped chute in a rearward direction from said liquid applicator and onto the base line of molten thermoplastic pavement marking as said carrier continues to move in a forward direction.

2. The apparatus for forming highway markings as described in claim 1, wherein each pavement marker includes a flat base surface, and wherein said hopper, pusher and chute are configured to maintain the pavement markers with the base surfaces of the pavement markers facing downwardly.

3. The apparatus for forming pavement markings as described in claim 1, wherein said chute has a sloped surface that moves the pavement markers toward the base line in a forward direction slower than the movement of the carrier in the forward direction.

4. The apparatus for forming highway markings as described in claim 3, wherein said chute includes a varied angle of descent.

5. The apparatus for forming highway markings as described in claim 3, wherein said chute has a flat surface for engagement by said pavement markers.

6. The apparatus for forming highway markings as described in claim 3, further including a chute adjustment means for adjusting the angle of slope of the chute.

7. The apparatus for forming highway markings as described in claim 3, further including a bead dispenser mounted on said carrier for dispensing reflective beads on said base line.

8. The apparatus for forming highway markings as described in claim 3, wherein the binder forming each pavement marker consists essentially of a tackifying resin, a pigment, a copolymer, and a plasticizer.

9. A mobile highway marking apparatus for advancing in a forward direction along a paved surface of a highway at a predetermined speed of advancement for applying a paint stripe to the paved surface and applying pavement markers at intervals on the paint stripe, the pavement markers each including a base surface and an opposed surface, said marking apparatus including a paint applicator for progressively applying the paint stripe to the paved surface of the highway as the marking apparatus advances in a forward direction, a dispenser carried by said marking apparatus for intermittently applying the pavement markers at intervals to the paint stripe, said dispenser including:

an upwardly extending hopper for holding an upwardly extending stack of the pavement markers, a delivery chute positioned adjacent said paint applicator and including a sloped delivery surface with an upper portion adjacent said paint applicator and a lower portion extending downwardly and away from said paint applicator in a direction opposite to the direction of movement of the marking apparatus, and an actuator positioned adjacent said upper portion of said delivery chute for moving the lowermost pavement marker from beneath others of said pavement markers in the stack of pavement markers in a forward direction to said applicator chute with the base surface of the pavement marker in engagement with said sloped delivery surface, such that said pavement markers slide rearwardly away from said paint applicator down said delivery chute with their base surfaces facing the direction of movement of said marking apparatus, such that the movement of the pavement markers rearwardly from said paint applicator diminishes the forward velocity of the pavement markers as the pavement markers engage the paint stripe.

10. The mobile highway marking apparatus of claim 9, wherein said actuator is configured to move the pavement markers in the forward direction of movement onto said delivery chute.

11. The mobile highway marking apparatus of claim 9, further including a chute adjustment means for adjusting the angle of slope of the chute.

12. The mobile highway marking apparatus of claim 9, further including a bead dispenser mounted on said carrier for dispensing reflective beads on said base line.

13. A mobile highway marking apparatus for advancing in a forward direction along a paved surface of a highway at a predetermined speed of advancement for applying a paint stripe to the paved surface of the highway and applying pavement markers at intervals on the paint stripe, the pavement markers each including a base surface and an opposed surface, said marking apparatus including a paint applicator for progressively applying the paint stripe to the paved surface of the highway as said marking apparatus advances, a dispenser carried by said marking apparatus for intermittently applying the pavement markers at intervals to the paint stripe that was applied to the paved surface, and said dispenser configured for moving in sequence the pavement markers from the bottom of a vertical stack of the pavement markers first in the forward direction toward said paint applicator and then down a sloped chute in a rearward direction to the paint stripe, wherein said dispenser includes a pusher for pushing the pavement markers in the forward direction onto said sloped chute.

14. The mobile highway marking apparatus of claim 13, wherein said sloped chute is configured to deliver the pavement markers under the influence of gravity with the base surfaces of the pavement markers sloped facing downwardly and forwardly of the marking apparatus.

15. The mobile highway marking apparatus of claim 13, wherein said pusher is formed in a shape that matches the shape of the pavement markers.

16. The mobile highway marking apparatus of claim 13, wherein said pavement markers are disk-shaped, and said dispenser includes a disk pusher that is formed with a pushing edge that matches the shape of the disks.

* * * * *